US011158299B2

(12) United States Patent
Chunren et al.

(10) Patent No.: US 11,158,299 B2
(45) Date of Patent: Oct. 26, 2021

(54) ACOUSTIC META-MATERIAL BASIC STRUCTURE UNIT, COMPOSITE STRUCTURE THEREOF, AND ASSEMBLY METHOD

(71) Applicant: Component Technologies, L.L.C., Burnsville, MN (US)

(72) Inventors: Yu Chunren, Shanghai (CN); Huang Lifan, Shanghai (CN)

(73) Assignee: Component Technologies, L.L.C., Indianapolis, IN (US)

( * ) Notice: Subject to any disclaimer, the term of this patent is extended or adjusted under 35 U.S.C. 154(b) by 286 days.

(21) Appl. No.: 15/532,832

(22) PCT Filed: Sep. 11, 2015

(86) PCT No.: PCT/CN2015/089418
§ 371 (c)(1),
(2) Date: Jun. 2, 2017

(87) PCT Pub. No.: WO2017/041283
PCT Pub. Date: Mar. 16, 2017

(65) Prior Publication Data
US 2019/0035373 A1 Jan. 31, 2019

(51) Int. Cl.
*G10K 11/162* (2006.01)
*G10K 11/172* (2006.01)

(52) U.S. Cl.
CPC ..... *G10K 11/162* (2013.01); *G10K 11/172* (2013.01)

(58) Field of Classification Search
CPC ..... G10K 11/162; G10K 11/172
USPC ..... 181/288
See application file for complete search history.

(56) References Cited

U.S. PATENT DOCUMENTS

| | | | | |
|---|---|---|---|---|
| 7,395,898 | B2 | 7/2008 | Yang | |
| 8,869,933 | B1 * | 10/2014 | McKnight | G10K 11/172 181/207 |
| 9,659,557 | B2 * | 5/2017 | Yang | G10K 11/172 |
| 10,043,508 | B2 * | 8/2018 | Park | G10K 11/02 |
| 2013/0087407 | A1 * | 4/2013 | McKnight | G10K 11/172 181/287 |
| 2015/0047923 | A1 * | 2/2015 | Chang | G10K 11/172 181/286 |

FOREIGN PATENT DOCUMENTS

| | | | |
|---|---|---|---|
| CN | 1664920 | A | 9/2005 |
| CN | 103594080 | A | 2/2014 |
| CN | 103996395 | A | 8/2014 |

* cited by examiner

*Primary Examiner* — Forrest M Phillips
(74) *Attorney, Agent, or Firm* — Gutwein Law; Greg N. Geiser

(57) ABSTRACT

This invention provides an acoustic metamaterial unit cell, consisting of a frame, a constraint stick placed in the frame and a piece of membrane covering at least one surface of the frame. This invention also provides an acoustic metamaterial plate comprised of the provided unit cells and a composite structure of acoustic materials. Additionally, the invention provides a method to design the operating frequency bands by modifying the structure and material properties of the frame, the constraint stick and the membrane in the proposed acoustic metamaterial. The proposed structure shows a priority in fabrication, stability and service life.

14 Claims, 6 Drawing Sheets

ACOUSTIC META-MATERIAL BASIC STRUCTURE UNIT, COMPOSITE STRUCTURE THEREOF, AND ASSEMBLY METHOD

FIELD

The present disclosure relates to an acoustic-metamaterial unit cell and its composite structures. They can be applied to fabricate sound barriers, acoustical enclosures and other sound-proof structures, which possess the light-weight feature and effectively soundproofing performance in low frequencies, belonging to the field of acoustic materials.

BACKGROUND

Acoustic metamaterials, especially the locally resonant sonic materials, provide an effective way to control the propagation of sound waves using subwavelength structures (2000, Zhengyou Liu et al., Locally Resonant Sonic Materials, Science 289, 1734; 2008, Z. Yang et al., Membrane-Type Acoustic Metamaterial with Negative Dynamic Mass, Physical Review Letters 101, 204301). This new type of acoustic materials breaks the limitation of the mass-law in the noise control field.

A typical unit cell of the present locally resonant acoustic metamaterials is constructed from three components, including a rigid frame, a piece of membrane or an elastic filler, and a mass, where the mass is connected to the membrane or the filler to form an oscillation system. The main working principle is that unit cells partition the whole plate into small, disconnected and relatively independent regions, and thus the whole plate can generate strongly and locally resonant vibration in every region due to the oscillation effects of the mass-membrane or mass-filler system excited by the incidence of sound waves. This locally resonant phenomenon can lead to a zero sum of the normal displacements of the unit cell at specific frequencies, which means that no sound wave is transmitted through the unit cell, or the Incident sound waves are totally reflected. For conventional locally resonant acoustic metamaterials, the operating frequencies are usually designed by adjusting the resonant frequencies of the mass-membrane or mass-filler system. Therefore, the acoustic metamaterials disclosed in patents (CN1664920A, CN103996395A, CN103594080A, CN103810991A, CN104210645A, U.S. Pat. No. 7,395,898B2, US20130087407A1, US20150047923A1) all contain a rigid mass in each unit cell. These acoustic metamaterials would be denoted here as MAMs (Mass-attached Acoustic Metamaterials), Different from MAMs, some current patents (CN10190833813, US20140339014A1) propose another construction of acoustic metamaterials which has no mass positioned on the membrane or in the filler. These acoustic metamaterials merely adopt the locally vibration modes of the elastic membrane or filler to reflect incident sound waves at specific frequencies. These acoustic metamaterials would be denoted here as NAMs (No-mass-attached Acoustic Metamaterials). However, there are some drawbacks in constructions and performances of the aforementioned MAMs and NAMs. Major issues are summarized as follows.

1. Because the strong vibration causes the mass detached from the membrane easily, MAMs are lack of stability and fail to provide a long-term service in harsh conditions. In addition, placing a small mass into each unit cell increases the complexity of assembly.

2. Instead of adjusting the parameters of the mass, e.g., weight and size, another method of tuning the operating frequencies of MAMs is to vary the pretension force applied to the elastic membrane. However, the pretension may release slowly as the elastic membrane suffers a long-time vibration, and thus MAMs usually have a shorter effective working time.
3. The total transmission phenomenon occurs inevitably after the total reflection phenomenon. Consequently, the MAM and NAM show poorer soundproofing performances than homogenous materials due to the total transmission phenomena at these frequencies. In particular, NAMs usually possess crowded and narrow total-transmission frequency bands, because it only relies on no-constrained vibrations of the membrane or the filler in unit cells.
4. In order to overcome the shortcoming of the narrow-band operating frequencies, traditional approaches try to place multi-weight masses into each unit cell, to stack multilayer MAMs or NAMs with different operating frequencies or to adopt both. However, these approaches may increase the weight, thickness and structural/complexity of the materials.

Aiming at these disadvantages of the conventional acoustic metamaterials, an innovative type of acoustic metamaterials, i.e., the constrained-membrane acoustic metamaterials (CAMs), is developed. The constrained membrane of the CAM can suppress undesirable vibration modes corresponding to the total sound transmission phenomenon and, meanwhile, create vibration modes for the total reflection phenomenon at low frequencies.

DESCRIPTION OF THE INVENTION

In order to overcome the drawbacks of current acoustic metamaterials, this invention provides an innovative acoustic metamaterial unit cell which can constrain specific vibration modes of the membrane by using constraint sticks. Meanwhile, the constraint sticks can also create the vibration modes corresponding to the total transmission phenomenon in low frequencies. Therefore, the effective bandwidth for sound insulation can be broadened only by using one layer of the proposed acoustic metamaterials.

Furthermore, the invention also provides composite structures based on the proposed acoustic metamaterials, i.e., CAM. These composite structures are constituted by the CAM and several types of conventional acoustic materials, e.g., glass fiber, foam and perforated plate, etc. In terms of the sound transmission loss (STL) of these composite structures, excellent sound insulation performance can be achieved at the peaks. Moreover, due to the near-field coupling effects between the CAM and the conventional acoustic materials, the STL values at the dips are improved significantly comparing with a bare CAM.

The detailed technical solutions of the invention are presented as follows.

A unit cell in the CAM consists of a frame, a constraint stick placed in the frame and a piece of membrane covering at least one surface of the frame.

In the unit cell, the constraint stick is rigidly connected to the frame. Meanwhile, the motion of the membrane is constrained not only by the frame but also by the constraint stick.

In the unit cell, the frame, the constraint stick and the rigid connector between them can be fabricated through unibody design e.g., milling process. Alternatively, these three components can be fabricated separately. Some machining methods such as riveting and sticking can be applied to assembly of the non-unibody parts.

In the frame, there is at least one constraint stick inside.

In the unit cell, both sides of the frame can be covered by membranes which possess the same thickness and material properties.

In the unit cell, porous absorption materials, e.g., glass fiber and foam, can be filled in the space which is naturally formed by the two membranes.

In the unit cell, the shape of the frame has no limit. However, in general, a maximum area ratio of the unit cell for periodic extending is expected, thus, regular shapes, e.g., regular hexagons and squares are preferred.

In the unit cell, the constraint stick is suggested to flush with both the top and bottom surfaces of the frame.

In the unit cell, the constraint area and the shape of the constraint stick have no limits. Arbitrary point contact, line contact and area contact between the constraint stick and the membrane can operate.

In the unit cell, the preferred materials chosen for fabricating the frame and the constraint stick possess low density and high Young's modulus, e.g., Aluminum, steel, rubber, plastic, glass, polymer and composite fiber.

In the unit cell, the membrane is made from flexible and toughness materials. Polymers, e.g., polyvinylchloride, polyethylene and polyetherimide are appropriate.

The invention also provides an acoustic metamaterial plate constructed by the described unit cells.

In the acoustic metamaterial plate, unit cells are arranged in-plane.

In the acoustic metamaterial plate, all the unit cells are designed with the same size, shape and material properties, which can achieve a good performance at the operating frequencies. Surely, the unit cells can also be designed to have different sizes, shapes and material properties, which can achieve a wider sound insulation bandwidth but lower STL values than those with the same size, shape and material properties at the operating frequencies.

The invention also provides some assembly methods. First, connect the frame and the constraint stick rigidly, and then cover the membrane on the surface of the frame and the constraint stick in a free-extension condition.

The invention also provides some types of acoustic composite structures, based on the described acoustic metamaterial plate.

The acoustic composite structures consist of traditional acoustic plates.

The invention also provides a method to adjust the operating frequency bands of the unit cells, the metamaterial plates and the composite structures. This adjustment method is mainly based on the modification for the sizes and material properties of the frames, the constraint sticks and the membranes.

Comparing with current techniques, this invention shows some superiorities in the following aspects.

1) The proposed acoustic metamaterial unit cell has no mass, which increases the working life and simplifies the fabrication process.
2) The proposed acoustic metamaterial unit cell is different from NAMs. Due to the constraint stick rigidly connected to the frame, some specific total transmission vibration modes of the membrane can be suppressed to avoid STL dips in low frequencies. Therefore, the operating frequency bandwidth of CAMs is wider than that of MANs and NAMs.
3) CAMs, possessing a simple construction, predigests manufacture and is suitable for modular assembly. The frame and the inner constraint stick can be fabricated though modeling, stamping and etching. Moreover, CAMs can be cut and assembled according to the application requirements easily.
4) Composite structures combined of the CAM and traditional materials present significant improvement of the sound insulation performance in frequencies between STL peaks. The numbers and shapes of the constraint sticks can be optimized to further reduce the areal density of the CAM. Thus, the thickness and the weight of the whole composite structure can be relatively small.

BRIEF DESCRIPTION OF THE DRAWINGS

FIG. 2(*a*) presents the vibration mode of the MAM. FIG. 2(*b*) presents the vibration mode of the NAM. FIG. 2(*c*) presents the vibration mode of the CAM. Three vertical arrows denote the incident directions of the sound waves.

FIGS. 3(*a*) and 3(*b*) are the exploded view and the sectional view of the unit cell respectively.

FIGS. 7(*a*) and 7(*b*) are the exploded view and the sectional view of the unit cell respectively.

In FIG. 11(*a*), there is an additional frame around the original constraint stick. Thus, the additional frame becomes the other constraint stick. In FIG. 11(*b*), the constraint stick is rigidly connected to the frame by only one connector. The unit cell in FIG. 11(*c*) is obtained from two adjacent square unit cell by removing the inner shared boundary of the frame.

Figure 1:
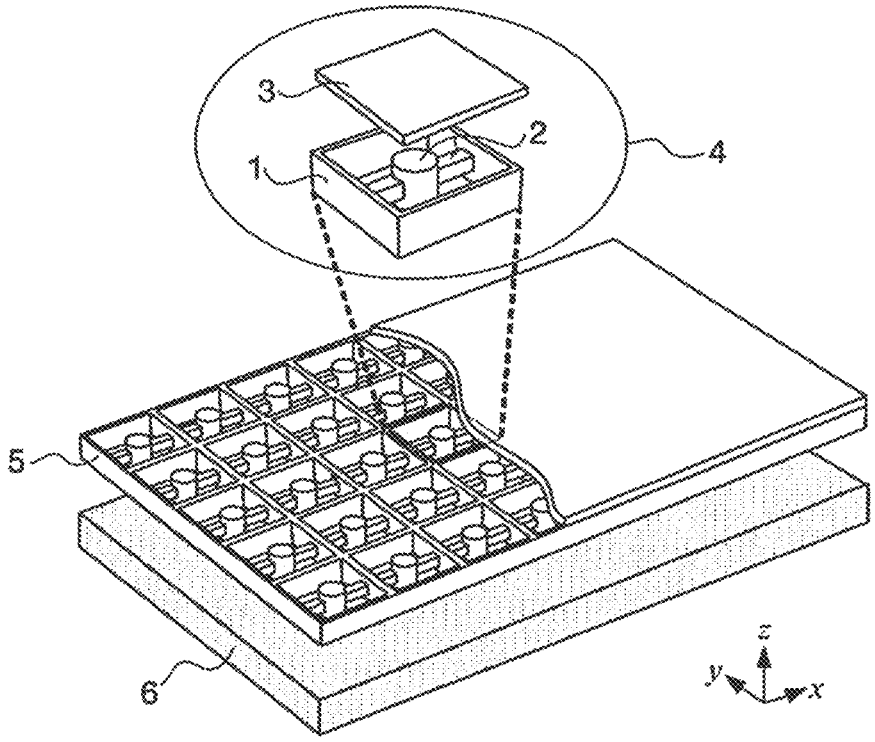
FIG. 1 is the schematic drawing of the acoustic metamaterial unit cell and its composite structure proposed in this invention.

In the figures, 1—frame, 2—constraint stick, 3—first membrane, 4—unit cell of the CAM, 5—CAM plate, 6—conventional acoustic material plate, 7—mass, 8—glass fiber, 9—second membrane, 10—glass fiber plate, 11—aluminium alloy plate, 12—constraint stick with a square frame, 13—constraint stick with a connector, 14—two constraint sticks in one unit cell.

DETAILED DESCRIPTION

A detailed description of the techniques used in this invention is presented with some samples and figures in this section. However, the solutions, implementations and protection of the patent right are not confined to the samples mentioned in this section.

An acoustic metamaterial unit cell which can constrain specific vibration modes of the membrane is introduced in this invention. It is mainly comprised of three components, including a frame, a constraint stick and membranes. A certain number of the unit cells are arranged in the in-plane direction, constructing a CAM plate, Unit cells with the same size, shape and material properties are preferred.

The constraint stick is rigidly connected to the frame and the membranes covering on the frame is restricted by the constraint stick. Better performance can be obtained if the constraint stick is flush with both the top and bottom surfaces of the frame. The frame, the constraint stick and the rigid connector between them can be manufactured into a unibody by special processing technics such as milling. Likewise, machining methods such as riveting and sticking can also be applied to connect the separated parts.

There is no limit to the shape of the frame, Regular shapes such as rectangles and regular hexagons are preferred since they can obtain a maximum area ratio for periodic extension of unit cells.

There is no limit to the shape of the constraint stick. Shapes which have point contact, line contact or surface contact with the membrane can work well. Further, smaller contact area shows a better performance. In other words, symmetrical or regular shapes, such as circles, squares and regular polygons usually provide excellent performances.

There is no limit to the number of the constraint sticks in the frame. Whereas one stick, at least, should be equipped within the area where maximum amplitude of the total transmission vibration occurs when there is no constraint in the frame. For example, in the unit cell of the MAM, the amplitude of the mass is maximum at the first total transmission peak. Hence, the mass is replaced by a constraint stick in the proposed structure. Benefiting from the constraint stick, the shape of free vibration part on the membrane suppresses the total transmission phenomena in specific frequencies but remains the total reflection phenomena. Therefore, sound can be effectively insulated. Different from this invention, the NAM disclosed in patents (CN101908338B, US2010339014) always has an inevitable total transmission peak in low frequencies which results in a minimum value of STL.

The frame and the constraint stick are made of materials which satisfy the requirements of strength and stiffness at the operating frequencies, e.g., aluminum, steel, rubber, plastic, glass, polymer and composite fiber. Rigid materials with low density and high Young's Modulus are preferred.

Materials with proper flexibility can be used to manufacture the membrane, e.g., elastic materials such as rubber or polymers such as polyvinyl chloride, polyethylene and polyetherimide.

No pre-tension force is exerted when the membrane is connected to the frame and the constraint stick. Namely, the membrane is fabricated in free extension condition.

Operating frequencies can be designed by adjusting the sizes and material properties of the frame, the constraint stick and the membrane. In other words, the frequency bands of sound insulation can be customized.

Taking full advantage of the space, membranes are suggested to cover on the both surfaces of the frame to achieve a better performance in sound insulation. The thickness and the material properties can be varied. Attributed to such structure, two main operating frequency bands can be obtained. Additionally, porous absorption materials, e.g., glass fiber and foam, can be filled between the two membranes. Hence, the sound insulation performance is further improved.

The acoustic composite structure is composed of the proposed CAM and conventional acoustic materials. Joint the CAM plate and the conventional plate and then squeeze them into the composite structure. Alternatively, the two plated can also be connected elastically, e.g., a small rubber mat can be placed between the plates.

In the composite structure, the parameters of the conventional materials are usually selected according to the ones generally used in this field. Nevertheless, the thickness of the sound barriers, the characteristic impedance and sound absorption performance of the porous absorption material, the parameters of the formed Helmholtz resonator are taken into consideration, so as to select the optimal conventional acoustic material which can cooperate well with the CAM at the operating frequencies.

In the composite structure, airtightness is not required. Micro pores can be made on the membrane so that a resonator can be formed between the membrane and the conventional acoustic materials. Accordingly, the sound insulation performance in specific frequencies can be improved.

Detailed implementation method is explained with figures as follows.

FIG. 1 is the schematic drawing of the unit cell in CAM and its composite structure proposed in this invention. As shown in the figure, the unit cell 4 is composed of the frame 1, the constraint stick 2 and the membrane 3. The CAM plate 5 is made up of a certain number of unit cells arranged in the in-plane direction. Unit cells with the same size and material properties bring about better performance. The CAM plate 5 and the conventional acoustic material plate 6 constitute a complete sound insulation structure. The conventional acoustic material plate has various types, e.g., homogenous sound barriers, porous absorption materials and perforated plate, etc.

Figure 2:
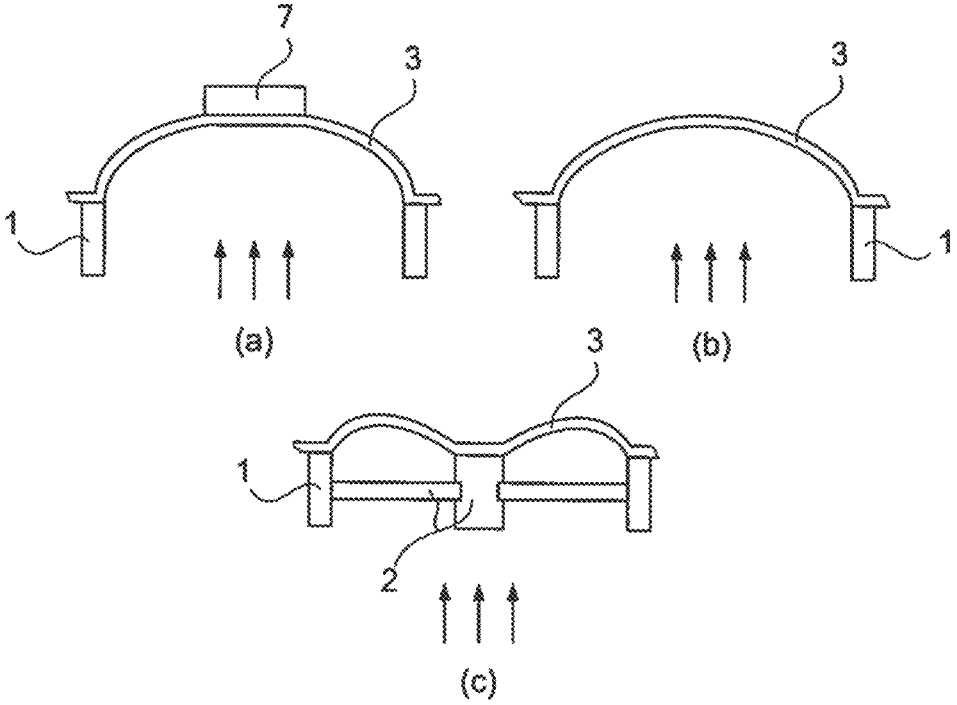
FIG. 2 shows the vibration modes corresponding to the first STL dips for three types of acoustic metamaterials.

FIG. 2 illustrates the vibration patterns of the first STL dips for three types of acoustic metamaterials. FIG. 2(*a*) presents the vibration mode of the MAM, FIG. 2(*b*) demonstrates the corresponding vibration mode of the NAM, and FIG. 2(*c*) is related to the the CAM. Three vertical arrows denote the incident directions of the sound waves. As shown in FIG. 2(*a*), at the first total transmission peak of MAM, mass 7 has the maximum vibration amplitude. Similarly, the center of the membrane 3 in NAM also has the maximum vibration amplitude according to FIG. 2(*b*). Consequently, there is an inevitable total transmission peak in these two structures, heading to the dip of STL. As shown in FIG. 2(C), to repair the dip of STL, the constraint stick 2 is equipped in the unit cell of the CAM where the vibration amplitude is maximum when there is no constraint. Owing to the shape of the free vibration part in membrane 3 which suppresses the vibration mode of total transmission while retains the vibration mode of total reflection, the incident sound waves can be insulated effectively.

Figure 3:
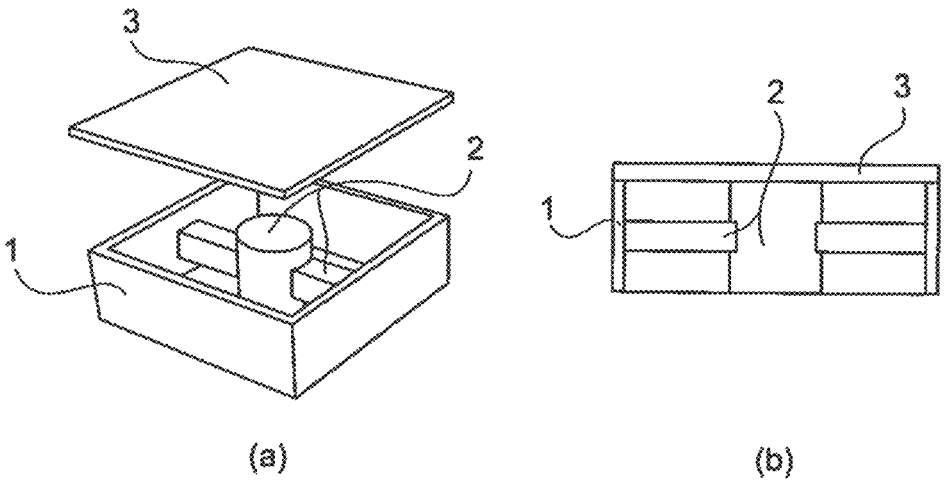
FIG. 3 is the schematic drawing of the unit cell in the sample 1.

FIG. 3 is the schematic drawing of the unit cell in the sample 1. FIGS. 3(*a*) and 3(*b*) are the exploded view and the sectional view of the unit cell respectively. The constraint stick 2 is rigidly connected to the frame 1. Meanwhile, the membrane 3 is connected to the frame 1 and the constraint stick 2 in free-extension condition. Then joint the constraint stick 2 and the center of the membrane 3. Sample 1 is one of the basic structure of the proposed CAM.

The frame 1 is a square with 10 mm in height, 26 mm by 26 mm inside and 29 mm by 29 mm outside. The shape of the contact area of the constraint stick 2 and the membrane 3 is a circle with a radius of 5 mm. The thickness of the membrane 3 is 0.05 mm. The frame 1 and the constraint stick 2 are made of the same material, the FR-4 glass fiber. The membrane 3 is made of polyetherimide.

Figure 4:
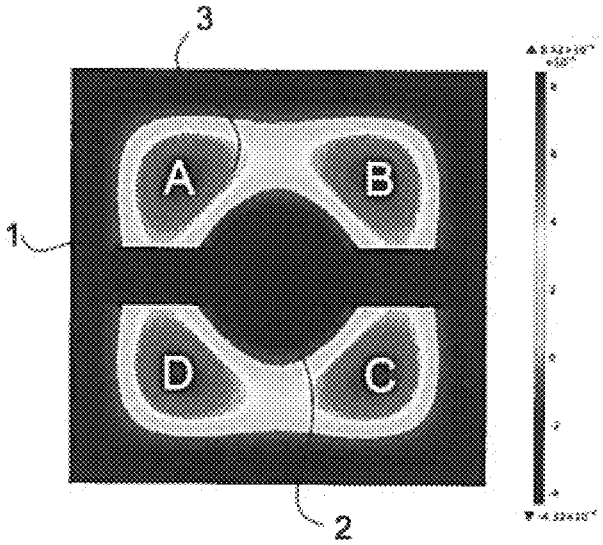
FIG. 4 demonstrates the finite element method (FEM) simulation result of the vibration pattern with respect to the first total reflection frequency of the CAM unit cell in the sample 1.

FIG. 4 demonstrates the FEM simulation result of the vibration mode at the first total reflection frequency of the basic CAM unit cell in the sample 1. Particularly, the operating frequency of total reflection for the unit cell is 140 Hz. Under this circumstance, the frame 1 and the constraint stick vibrate in the same direction while membrane 3 vibrates in the opposite direction. In this case, the four corners of the membrane (denoted as A-D in FIG. 4) have maximum vibration amplitude.

Figure 5:
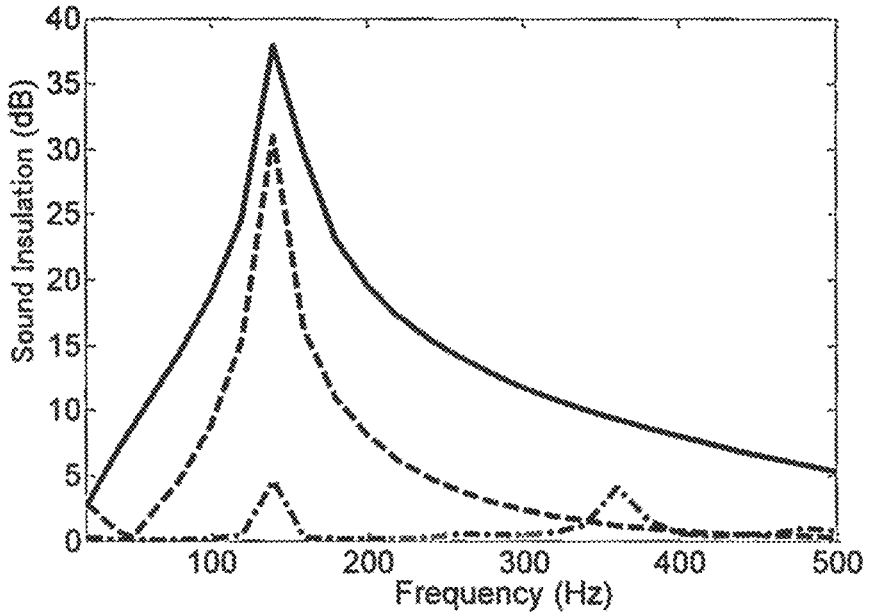
FIG. 5 presents a comparison of the FEM simulated STL results of the unit cells in the sample 1, in the MAM and in the NAM.

FIG. 5 presents a comparison of the FEM simulated STL results of the unit cells in the sample 1, in the MAM and in the NAM. The solid curve is related to sample 1, the dotted curve shows the relevant results of the MAM and the dash dot curve indicates the result of the NAM.

Referring to FIG. 2(*a*), the frame 1 in the unit cell of the MAM is also 10 mm high. The difference lies in the size which is 33 mm by 33 mm inside and 37 mm by 37 mm outside. The mass 7 is a cylinder with a radius of 5 mm and a thickness of 2 mm. The thickness of the membrane 3 is 0.05 mm. The frame is made of FR-4 glass fiber, the mass is manufactured by 6063 aluminum alloy, and the membrane is made of polyetherimide. In terms of FIG. 2(*b*), the frame 1 and the membrane 3 in the unit cell of the NAM is identical to the ones in the MAM, except for the size of the frame. Particularly, the frame in NAM is 58 mm by 58 mm inside and 62 mm by 62 mm outside According to FIG. 5, all the STL results of the three types of acoustic material unit cell have peaks at 140 Hz which are corresponding to the total reflection vibration mode. There is no dip in the result of sample 1. Whereas, dips occur in the other two situations resulting from the total transmission vibration mode of the unit cells in the low frequencies.

Figure 6:
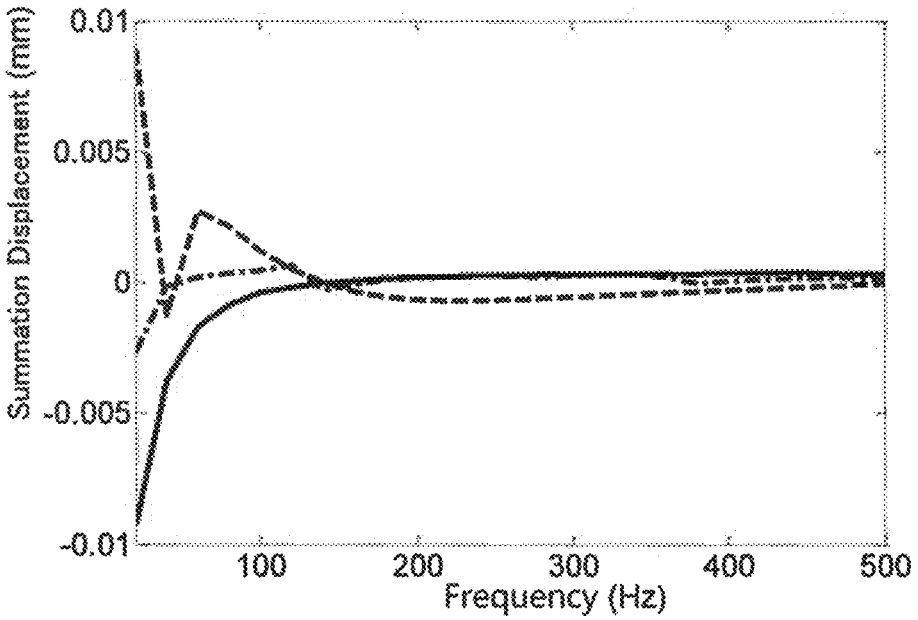
FIG. 6 presents the comparison of the FEM simulated sum of normal displacements of the three kinds of unit cells aforementioned.

FIG. 6 presents the comparison of the FEM simulated sum of normal displacements of the three aforementioned unit cells. At 140 Hz, total reflection vibration modes occur in all the three types of unit cells. Under this circumstance, the sums of normal displacements are zero. Furthermore, it is found that the curves of MAN and NAM fluctuate obviously but the curve of sample 1 is relatively flat. This phenomenon is also attributed to the constraint stick which constraints the vibration of the membrane.

Figure 7:
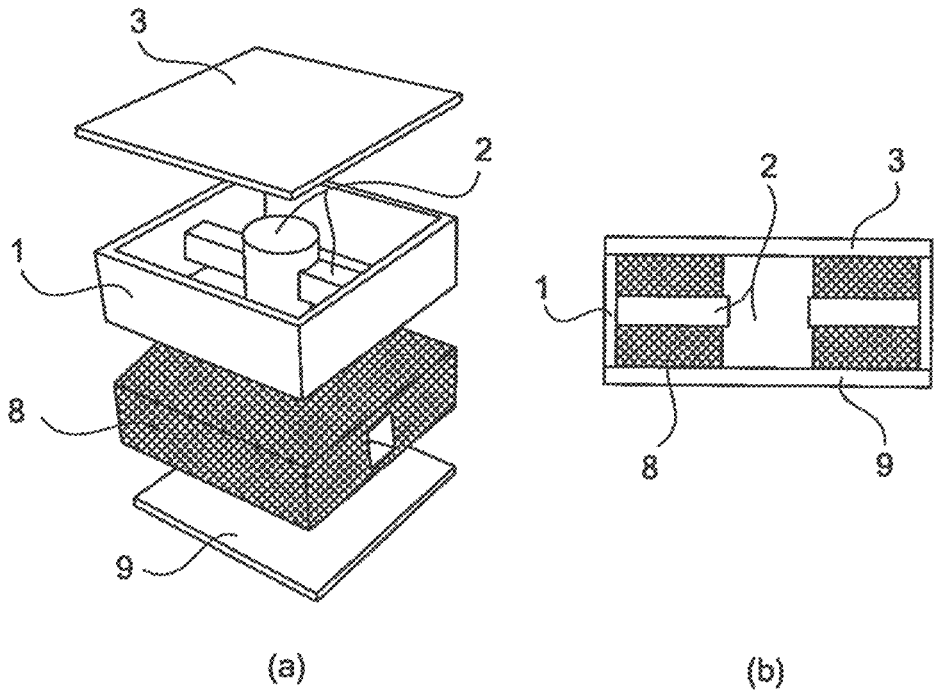
FIG. 7 shows the schematic drawing of the CAM unit cell in the sample 2.

Sample 2 is an expansion of the sample 1 for the sake of a more compact structure and an improved performance. FIG. 7 shows the schematic drawing of the CAM unit cell in the sample 2. FIGS. 7(*a*) and 7(*b*) are the exploded view and the sectional view of the unit cell respectively. The top and the bottom surface of the frame 1 are covered with the first membrane 3 and the second membrane 9. Glass fiber 3 is filled between the membrane 3 and the membrane 9.

The frame 1 is 10 mm in height, 30 mm by 30 mm inside and 33 mm by 33 mm outside. The shape of the contact area of the constraint stick 2 and the membrane 3 is a circle with a radius of 5 mm. Both membrane 3 and 9 have a thickness of 0.05 mm. The frame 1 and the constraint stick 2 are both made of FR-4 glass fiber. The membrane 3 and the membrane 9 are made of polyetherimide. The flow resistivity of the glass fiber 8 is 21000/Nsm$^{-4}$.

Figure 8:
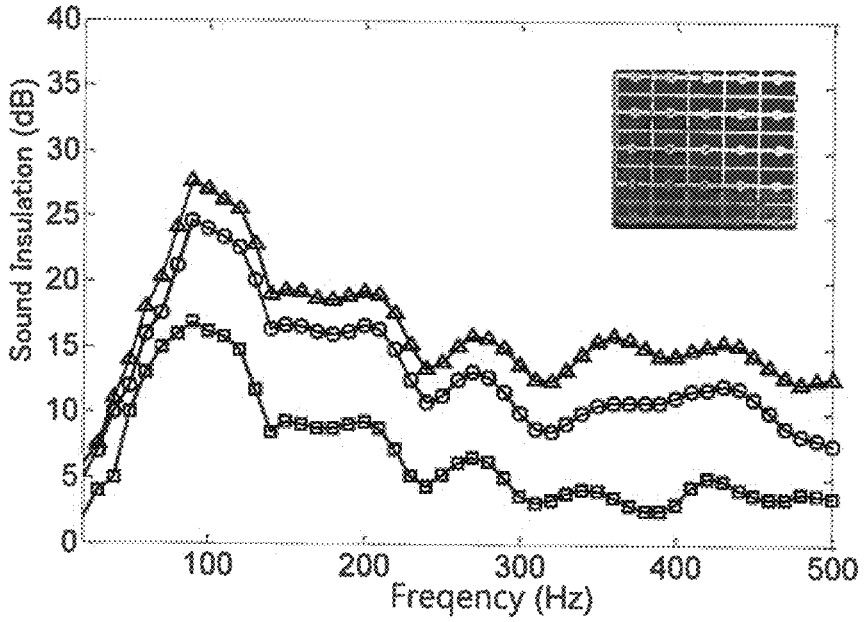
FIG. 8 presents the experimental STL results of the sample 2, the MAM and the NAM obtained from the impedance tube measurements.

According standard E2611-09 set by ASTM (American Society for Testing and Materials), "Standard test method for measurement of normal incidence sound transmission of acoustical materials based on the transfer matrix method", the experimental STL results of the sample 2, the MAM and the NAM are measured by the four-microphone method in the impedance tube as shown in FIG. 8. In the figure, the curve with triangles denotes the STL result of the sample 2. The STL result of the structure which removes the glass fiber 8 in the sample 2 is depicted by the curve with circles. Experiments are also done for the structure which takes out both the glass fiber 8 and the membrane 9 in the sample 2. The result is presented by the curve with squares. The figure in top right corner is the photographic image of the structure. Obviously, the STL results of the curve with squares is the smallest while the ones of the curve with triangles is the largest. Comparing with the structure of the curve with squares, the structure represented by the curve with circles is equipped with another membrane 9. The two-layer structure takes advantage of the other surface of the frame and the constraint stick to form another layer of vibration units. Accordingly, the two layers of vibration units can combine various vibration modes so as to insulate the sound wave more effectively. Due to the second layer of membrane, the STL is increased by 10 dB in average. The additional glass fiber 8 provides another 3-5 dB improvement. Generally, thin glass fibers with a thickness below 10 mm have a low acoustical absorption coefficient, usually smaller than 0.3, at frequencies lower than 500 Hz. As a result, the sound insulation effect of the glass fiber is negligible. In a contrast, the glass fiber in the sample 2 provides an improvement of 3-5 dB, which is owing to the strong coupling of the two layers of the membranes, leading to a significant increase in sound pressure and sound energy density. Then, sound pressure and sound energy density increase significantly. In this situation, even a thin layer of sound absorption material shows considerable sound insulation effect.

Figure 9:
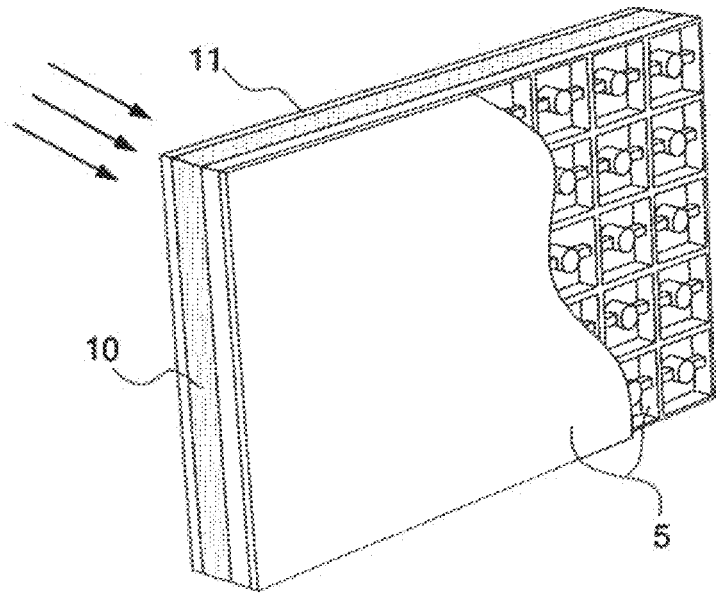
FIG. 9 illustrates the schematic drawing of the composite structure described in the sample 3.

FIG. 9 illustrates the schematic drawing of the composite structure described in the sample 3. A glass fiber plate 10 with a thickness of 1 inch and a 6063 aluminium alloy plate 11 with a thickness of 1 mm are selected to construct the conventional acoustic material in the sample 3. The flow resistivity of the glass fiber plate 10 is 21000/Nsm$^{-4}$. Three vertical arrows denote the incident directions of the sound waves. As depicted, the sound waves first reach to the aluminium alloy plate 11.

Figure 10:
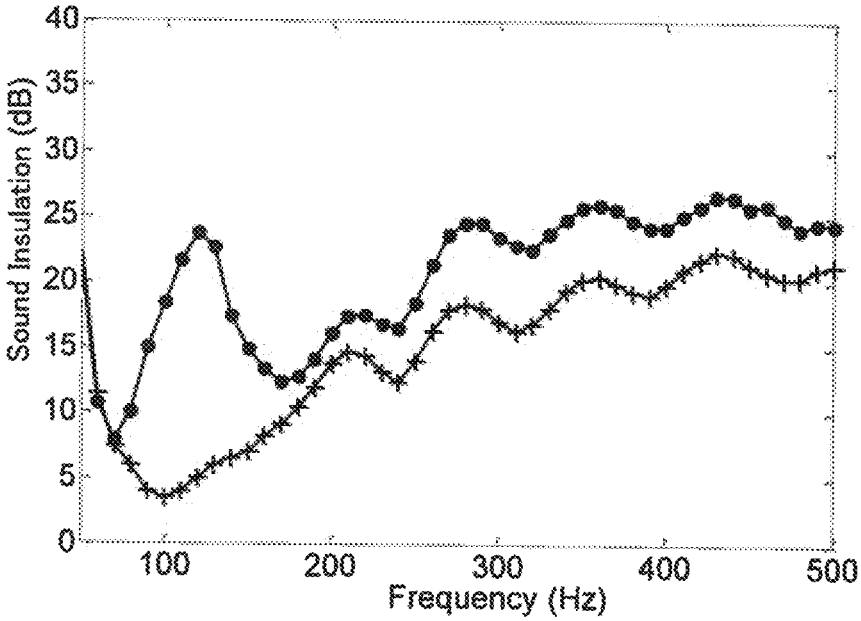
FIG. 10 presents the experimental STL results of the sample 3 obtained from the impedance tube measurements.

FIG. 10 presents the experimental STL results of the sample 3 obtained from the impedance tube measurements. In the figure, the curve with dots indicates the results of the sample 3 while the curve with crosses is related to the results of the aluminium alloy plate 11. The shape of the sample 3 is a circle with a diameter of 225 mm. Material and size of the unit cells in the CAM plate 5 in the sample 3 is identical to the unit cell in sample 1. As demonstrated in the figure, there is a dip in the STL results of the 6063 aluminium alloy plate at 100 Hz. That is the result of total transmission phenomena. Generally, when a homogenous layer of plate is activated by the incident sound waves, most of the energy is transmitted to the other side of the plate. Thus, dips appear, in other words, the material can hardly provide any sound insulation effect. To overcome the defects, glass fiber 10 and the CAM plate 5 are equipped on the basis of the aluminium alloy plate, which repairs the dip at the specific frequency. Therefore, the proposed structure provides a solution to improve the sound insulation effect in the frequencies where conventional materials fail to provide a satisfying performance.

Figure 11:
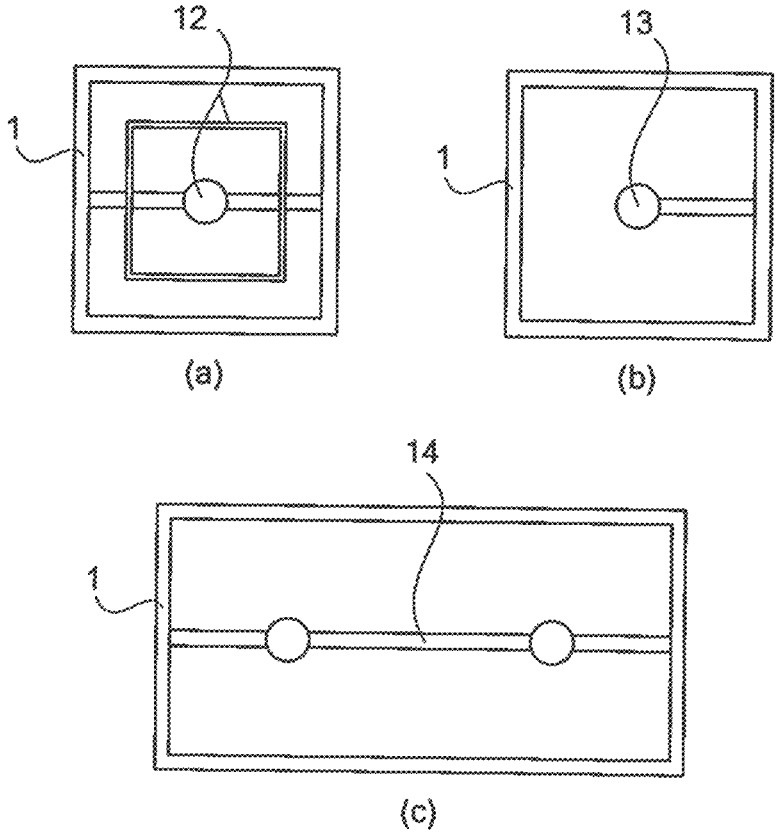
FIG. 11 shows the schematic drawing of three types of constraint sticks.

FIG. 11 shows the schematic drawing of three types of constraint sticks. In FIG. 11(*a*), there is an additional frame around the original constraint stick. Thus, the additional frame becomes another constraint stick. In FIG. 11(*b*), the constraint stick is rigidly connected to the frame by only one connector. This structure is suitable for applications where the inner diameter of the frame is small enough. Taking advantage of this structure, weight of the CAM is reduced. Meanwhile the constraint stick is still rigidly connected to the frame. The unit cell in FIG. 11(*c*) is a combination of the two adjacent unit cells by removing the inner shared boundary of the frame.

Figure 12:
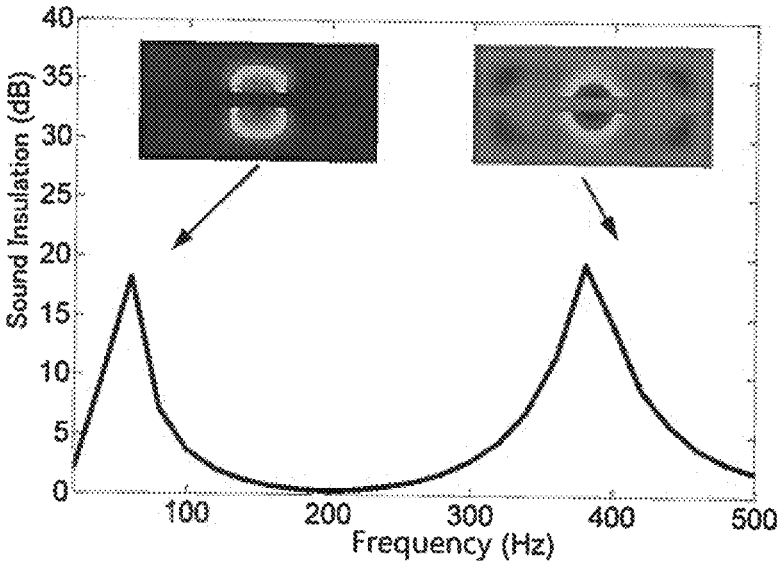
FIG. 12 demonstrates the FEM simulated STL results and the vibration patterns with respect to the two total reflection peaks of the CAM unit cell hi the sample 4.

The unit cell depicted in FIG. 11(*c*) is simulated by FEM. In particular, the frame 1 is a square with 10 mm in height, 63 mm by 63 mm inside and 66 mm by 66 mm outside. The shapes of the contact area of the constraint stick 14 and the two layers of membranes are both circles whose radius is 5 mm. The two layers of membranes are both 0.05 mm thick. The frame 1 and the constraint stick 14 are made of FR-4 glass fiber. The membranes are made of polyetherimide. The FEM simulated STL results are demonstrated in FIG. 12. As is indicated in the figure, there are two STL peaks at 60 Hz and 380 Hz respectively in the range of 0-500 Hz. Besides, the vibration modes of the two total reflection peaks are also depicted in the figure. The operating frequencies of the structure proposed in this invention can be designed according to specific requirements by tuning the location and the size of the constraint stick.

EXAMPLES

Measurement methods and materials applied in the samples are explained in this section.

Impedance tube measurements: according the standard E2611-09 set by ASTM (American Society for Testing and Materials), "Standard test method for measurement of normal incidence sound transmission of acoustical materials based on the transfer matrix method", STL is measured by the four-microphone method in the impedance tube.

FEM simulation of the vibration modes of acoustic metamaterial unit cells at specific frequencies:

The FEM calculation model of the unit cell is built based on the Acoustic-Solid Interaction, Frequency Domain Interface, a module in a finite-element analysis and solver software package, COMSOL Multiphysics 5.0. This model consists of two kinds of physical fields, the solid field comprised of the frame, the constraint stick and the membrane, and the acoustic field composed of the incident and transmitted air cavity. Coupling of the two fields is achieved by the acoustic-solid boundary condition. Boundary condition of Floquet periodicity is applied on the unit cell so as to simulate the periodic extension of the unit cells in the practical fabrication. Each natural vibration frequencies and the corresponding vibration modes can be obtained through eigenfrequency calculation. When analyzing the vibration modes activated by sound waves with specific frequency, the wave vector and the amplitude of the incident sound waves should be set in the incident air cavity. Then calculate for sweep frequencies with a range from 10 Hz to 500 Hz, a step of 10 Hz. Finally, results of the vibration modes can be obtained in postprocessing.

Measurement method for the FEM simulated STL of acoustic metamaterial unit cells:

Based on the aforementioned FEM simulation method, set the incident sound waves as plane waves with a frequency range from 10 Hz to 500 Hz, a step of 10 Hz. A part of the incident sound waves are reflected and the other part is transmitted. The normal transmission loss can be calculated by the energy of incident waves and transmitted waves, denoted as follows (STL represents the normal transmission loss not otherwise specified).

$$TL_n = 10\log_{10}(E_i/E_t)$$

In the equation above, $E_i$ is the incident acoustic energy. $E_t$ is the transmitted acoustic energy. They can be calculated by the sound pressure in the incident and transmitted air cavity.

Measurement method for the FEM simulated sum of normal displacements of acoustic metamaterial unit cells:

Based on the measurement method of the FEM simulated STL, the extraction and summing of the normal displacements (default name in COMSOL Multiphysics 5.0 is w) of each node on the unit cell can be done. Then the coordinate system, which takes the normal displacements of the unit cell as the y-coordinate and the corresponding frequencies of incident sound waves as the x-coordinate can be drawn, namely, the diagram of FEM simulated sum of normal displacement.

Polymers used in the samples are all ready-made.

Sample 1 Fabrication and Performance Measurement of the Bask CAM Unit Cells

Fabrication and performance measurement of the basic CAM unit cells are introduced with FIG. 3-6 as follows.

1. Fabrication of the basic CAM unit cells

The frame 1 used in sample 1 is made of FR-4 glass fiber, with 10 mm in height, 26 mm by 25 mm inside and 29 mm by 29 mm outside. The constraint stick 2 is also made of FR-4 glass fiber and is made into a unibody with the frame. The membrane 3 is made of polyetherimide and 0.05 mm thick. It is connected to the frame and the constraint stick in free extension condition. Furthermore, the contact area of the constraint stick 2 and the membrane 3 is a circle with a radius of 5 mm. With the parameters above, a basic CAM unit cell as FIG. 3 is obtained.

2. Performance measurement of the basic CAM unit cells

The CAM unit cell in the sample 1 is simulated by FEM at the first total reflection frequency, 140 Hz. The result is depicted in FIG. 4 which indicates the frame and the constraint stick vibrate in the same direction, while membrane 3 vibrates in the opposite direction. Moreover, the four corners of the membrane (denoted as A-D in FIG. 4) have maximum vibration amplitude.

3. Comparison with the current acoustic metamaterials

The structures of current acoustic metamaterials used in the comparison are shown in FIG. 2(*a*) and FIG. 2(*b*). The frame 1 in the unit cell of the MAM is also made of FR-4 glass fiber, 10 mm in height. The difference lies in the size which is 33 mm by 33 mm inside and 37 mm by 37 mm outside. The mass 7 is a cylinder made of 6063 aluminum alloy with a radius of 5 mm and a thickness of 2 mm. The membrane 3 is made of polyetherimide and 0.05 mm thick.

Referring to FIG. 2(*b*), the frame 1 and the membrane 3 in the unit cell of the NAM is identical to the ones in the MAM, except for the size of the frame. In particular, the frame in the NAM is 58 mm by 58 mm inside and 62 mm by 62 mm outside The comparison of the FEM simulated STL results of the unit cells in the sample 1, in the MAM and in the NAM is displayed in FIG. 5. The solid curve is the corresponding results of sample 1, the dotted curve is related to the MAM and the dash dot curve shows the result of the NAM.

All the STL curves of the three types of unit cells have peaks at 140 Hz. These peaks are corresponding to the total reflection vibration mode. There is no dip in the result of sample 1. However, there are dips in the curves of the other two structures, which arise from the total transmission vibration mode of the unit cells at the low frequencies.

Additionally, the comparison of the FEM simulated sum of normal displacements of the three aforementioned unit cells is demonstrated in FIG. 6. At 140 Hz, total reflection vibration modes occur in all the three types of unit cells. Under this circumstance, the sums of normal displacements are zero. Furthermore, curves of MAN and NAM fluctuate obviously but the curve of sample 1 is relatively flat. This phenomenon is also attributed to the constraint stick which constrains the area with maximum amplitude of the membrane.

Sample 2 Fabrication and Performance Measurement of the CAM Unit Cells with Two Layers of Membranes 1. Fabrication of the basic CAM unit cells with two layers of membranes The frame 1 is 10 mm in height, 30 mm by 30 mm inside and 33 mm by 33 mm outside. The constraint stick 2 is designed as FIG. 7 shown and is made into a unibody with the frame. Both the frame 1 and the constraint stick 2 are made of FR-4 glass fiber. The two layers of the membranes, membrane 3 and membrane 9, are made of polyetherimide and have a thickness of 0.05 mm. Cover the membrane 3 on the top surface of the frame 1 and the constraint stick 2 in free-extension condition. The contact area of the constraint stick 2 and the membrane 3 is a circle with a radius of 5 mm. Then, the glass fiber 8, whose flow resistivity is 21000/Nsm-4, is filled between the frame 1 and the constraint stick 2. Finally, cover the membrane 9 on the bottom surface of the frame 1 and the constraint stick 2 in free-extension condition. The contact area of the constraint stick 2 and the membrane 9 is also a circle with a radius of 5 mm.

2. Performance measurement of the basic CAM unit cells with two layers of membranes According to standard E2611-09 set by ASTM (American Society for Testing and Materials), "Standard test method for measurement of normal incidence sound transmission of acoustical materials based on the transfer matrix method", the experimental STL results of the sample 2, the MAM and the NAM are measured by the four-microphone method in the impedance tube, which is shown in FIG. 8. In the figure, the curve with triangles indicates the STL result of the sample 2. The STL result of the structure which removes the glass fiber 8 in the sample 2 is demonstrated by the curve with circles. Experiments are also done for the structure which takes out both the glass fiber 8 and the membrane 9 in the sample 2. The result is presented by the curve with squares. The figure in top right corner is the photographic image of the structure. Obviously, the STL results of the curve with squares are the smallest while the ones of the curve with triangles are the largest. This is attributed to the additional membrane 9 in the structure of the curve with circles, comparing with the structure of the curve with squares. The two-layer structure takes full advantage of the other surface of the frame and the constraint stick to form another layer of vibration units. Accordingly, the two layers of vibration units can combine various vibration modes so as to insulate the sound wave more effectively. Owing to the second layer of membrane, the STL is increased by 10 dB in average. On the account of the structure of the curve with circles, an additional glass fiber 8 provides another 3-5 dB improvement.

Generally, thin glass fibers with a thickness below 10 mm have a low acoustical absorption coefficient, usually smaller than 0.3, at frequencies lower than 500 Hz. As a result, the sound insulation effect of the glass fiber is negligible. Contrarily, the glass fiber in the sample 2 provides an improvement of 3-5 dB, which is owing to the strong coupling of the two layers of the membranes, leading to a significant increase in sound pressure and sound energy density. In this situation, even a thin layer of sound absorption material provides considerable sound insulation effect.

Sample 3 Fabrication and Performance Measurement of the Acoustic Composite Structures Numbers of unit cells in sample 1 are arranged in the in-plane direction (xy-plane), constituting the CAM plate 5. A glass fiber plate 10 with a thickness of 1 inch and a 6063 aluminium alloy plate 11 with a thickness of 1 mm are selected to construct the conventional acoustic material in the sample 3. The flow resistivity of the glass fiber plate 10 is 21000/Nsm-4. Joint the CAM plate and the conventional plate and then squeeze them into the composite structure shown in FIG. 9. The STL of the composite structure is measured in the impedance tube, shown in FIG. 10. In the figure, the curve with dots indicates the results of the sample 3 while the curve with crosses is related to the results of the aluminium alloy plate 11 with a thickness of 1 mm. The shape of the sample 3 is a circle with a diameter of 225 mm. Material and size of the unit cells in CAM plate 5 is identical to the unit cell in sample 1. As demonstrated in the figure, there is a dip in the STL results of 6063 aluminium alloy plate at 100 Hz. That is the result of total transmission phenomena. To overcome the defects, glass fiber 10 and the CAM plate 5 are equipped on the basis of the aluminium alloy plate, which repairs the dip at the specific frequency. Therefore, the proposed structure provides a solution to improve the sound insulation effect in the frequencies where conventional materials fail to provide a satisfying performance.

Sample 4 Fabrication and Performance Measurement of the CAM Unit Cells with Another Type of Constraint Stick The frame 1 is made of FR-4 glass fiber, 10 mm in height, 63 mm by 63 mm inside and 66 mm by 66 mm outside. The constraint stick is designed as FIG. 11(*c*), removing the inner shared boundary of the frame of two adjacent unit cells, thus the frame of this type is a rectangle. The constraint stick 14 is connected to the frame 1 by sticking and it is connected to the membranes in the two constraint areas, restraining the vibration modes of the membranes. The first membrane 3 is made of polyetherimide and 0.05 mm thick. The membrane is connected to the frame 1 and the constraint stick 14 in free-extension condition. The shape of the contact area of the constraint stick 14 and the membrane 3 is a circle with a radius of 5 mm. With the parameters above, the unit cell shown in FIG. 11(*c*) is obtained. The unit cell is simulated by FEM and the results is displayed in FIG. 12. As is indicated in the figure, there are two STL peaks at 60 Hz and 380 Hz respectively in the range of 0-500 Hz. Besides, the vibration modes of the two total reflection peaks are also depicted in the figure.

Sample 4 indicates that the operating frequencies of the structure proposed in this invention can be designed according to specific requirements by tuning the location and the shape of the constraint stick.

Samples enumerated above are only the detailed examples in this invention. Modifications and deformations are allowed. However, modifications and deformations belonging to the the claims and techniques of this invention are all under the protection of this invention.

The invention claimed is:

1. An acoustic metamaterial unit cell, the acoustic metamaterial unit cell comprising:

a frame;

a constraint stick rigidly connected to the frame, the constraint stick placed within an interior of the frame; and a first membrane covering an at least one surface of the frame and the constraint stick, wherein motion of the membrane is constrained by the frame and the constraint stick.

2. An acoustic metamaterial unit cell as in claim 1, wherein the frame includes at least one constraint stick within the interior.

3. An acoustic metamaterial unit cell as in claim 2, wherein the frame is covered by a second membrane-on an opposed surface of the frame opposite the at least one surface, the second membrane being the same thickness and material properties as the first membrane.

4. An acoustic metamaterial unit cell as claimed in claim 3, wherein a porous absorption material is filled in an entire volume of an interior space between the first membrane and the second membrane.

5. An acoustic metamaterial unit cell as in claim 4, wherein the shape of the frame is selected from the group comprising, circles, squares, rectangles, and hexagons.

6. An acoustic metamaterial unit cell as claimed in claim 1, wherein the constraint stick is affixed flush with both a top and a bottom surface of the frame.

7. An acoustic metamaterial unit cell as in claim 1, wherein a constraint area and the shape of the constraint stick is selected from the group comprising, circles, squares, rectangles, and hexagons.

8. An acoustic metamaterial unit cell as in claim 1, wherein the materials selected for fabricating the frame and the constraint stick is selected from the group comprising aluminum, steel, rubber, plastic, glass, polymer and composite fiber.

9. An acoustic metamaterial unit cell as is claimed in claim 1, wherein the membrane is made from a flexible material.

10. An acoustic metamaterial plate, the acoustic metamaterial plate comprising:

a plurality of acoustic metamaterial unit cells in a cooperative assembly, each acoustic metamaterial unit cell comprising:

a frame;

a constraint stick, the constraint stick rigidly connected to the frame and placed within an interior of the frame; and a first membrane covering at least one surface of the frame.

11. An acoustic metamaterial plate as in claim 10, wherein the cooperative assembly of the acoustic metamaterial unit cells are arranged in-plane.

12. An acoustic metamaterial plate as in claim 11, wherein all the unit cells are provided in the same size, shape and material properties.

13. A method to assemble an acoustic metamaterial unit cell, the method comprising the steps of:

connecting the frame and the constraint stick rigidly together; and covering a surface of the frame and the constraint stick with a membrane in a free-extension condition.

14. A method to adjust the operating frequency bands of acoustic metamaterial unit cell as in claim 1, wherein the size of the frame, the constraint stick, and the membrane is modified.

* * * * *